United States Patent [19]

Miyashita et al.

[11] Patent Number: 5,027,744

[45] Date of Patent: Jul. 2, 1991

[54] DEVELOPING DEVICE WITH DEVELOPMENT ELECTRODE CLEANING UNIT

[75] Inventors: Hiroshi Miyashita, Hoi; Masahiko Kanehisa, Tsushima, both of Japan

[73] Assignee: Brother Kogyo Kabushiki Kaisha, Nagoya, Japan

[21] Appl. No.: 444,971

[22] Filed: Dec. 4, 1989

[30] Foreign Application Priority Data

Dec. 5, 1988 [JP] Japan ..... 63-158818[U]

[51] Int. Cl.[5] ..... G03G 15/06

[52] U.S. Cl. ..... 118/652; 118/647; 118/662; 355/270; 355/256; 355/264; 430/103; 430/117

[58] Field of Search ..... 118/652, 662, 647, 648; 430/103, 117–119; 355/255, 256, 260, 261, 262, 264, 265, 270, 296

[56] References Cited

U.S. PATENT DOCUMENTS

| | | | |
|---|---|---|---|
| 3,892,481 | 7/1975 | Schaefer et al. | 355/264 |
| 4,021,111 | 5/1977 | Kuroishi | 355/264 X |
| 4,025,184 | 5/1977 | Mochizuki | 355/264 X |
| 4,423,134 | 12/1983 | Miyakawa et al. | 355/264 X |
| 4,873,545 | 10/1989 | Yamana et al. | 355/256 |

FOREIGN PATENT DOCUMENTS

| | | | |
|---|---|---|---|
| 63-94285 | 4/1988 | Japan | 355/264 |

*Primary Examiner*—R. L. Moses

*Attorney, Agent, or Firm*—Kane, Dalsimer, Sullivan, Kurucz, Levy, Eisele & Richard

[57] ABSTRACT

A developing device which utilizes a development solution having toner particles actuated in the electric field generated by an electromember is provided with a cleaning unit to remove excess toner particles from the surface of the electrode member. The unit includes an air blower which directs air onto the electrode member and blows excess developing solution off the electrode.

16 Claims, 2 Drawing Sheets

DEVELOPING DEVICE WITH DEVELOPMENT ELECTRODE CLEANING UNIT

BACKGROUND OF THE INVENTION

The present invention relates to a developing device which is employed in a wet type electrophotographic apparatus and the like, more particularly, to a developing device having a development electrode cleaning unit for cleaning the development electrode which is provided with the developing device so that an improved image is obtained through a developing operation executed by the developing device.

Conventionally in this type of developing device a development electrode is employed to generate an electric field to propel toner particles included in the developing solution. Without such an electrode it would take a relatively long time to develop an image on a surface of photo-conductive material on which a latent image has been formed simply by dipping the photo-conductive material in the developing solution. Further, if the development electrode is not employed, the image obtained through the developing operation is strongly affected by the so-called "Edge" effect.

Thus, the conventional developing device is provided with at least one development electrode, for generating an electric field to propel the toner particles, so as to shorten the time required for obtaining a sufficiently clear image as well as to remove the affect of the Edge effect. The developing device which is provided with a development electrode supplies the developing solution to the development electrode so as to cause the developing solution to contact with the photoconductive material.

However, since residual toner is gradually stuck to the surface of the development electrode with each developing operation, the intensity of the electric field generated by the development electrode is weakened. Thus, it becomes necessary to clean the surface of the development electrode.

The following two methods for cleaning the surface of the development electrode have been widely employed.

(1) Dismounting the development electrode from the developing device and wiping the residual toner stuck to the surface of the development electrode with a piece of cloth or sheet, or (2) Applying a DC(Direct Current) voltage which is the same polarity as that of the toner particles to the development electrode, and simultaneously, vibrating the development electrode with an ultra-sonic wave for removing the residual toner, as disclosed in Japanese Patent Provisional Publication SHO No. 50-1745.

However, in the above method (1), it becomes necessary to dismount the development electrode from the developing device in order to clean it. Further, the cleaning operation is complicated and takes much time.

On the other hand, in the above method (2), the circuit required for oscillating the ultra-sonic wave is complicated and the total cost of the developing device increases.

SUMMARY OF THE INVENTION

It is therefore an object of the invention to provide an improved developing device utilizing a development electrode and provided with means for cleaning the development electrode to avoid the problem of residual toner sticking.

For this purpose, according to the invention, there is provided a developing device utilizing a developing solution including toner particles and comprising at least one development electrode member for generating an electric field to propel said toner particles, said developing device further comprising:

means for transporting a material on which said toner particles are to be coated, having a predetermined positional relationship with said development electrode member; and means for blowing air on to a surface of said development electrode member after said material is coated with said toner particles actuated by said development electrode member.

DESCRIPTION OF THE ACCOMPANYING DRAWINGS

DESCRIPTION OF THE PREFERRED EMBODIMENT

Figure 1A:
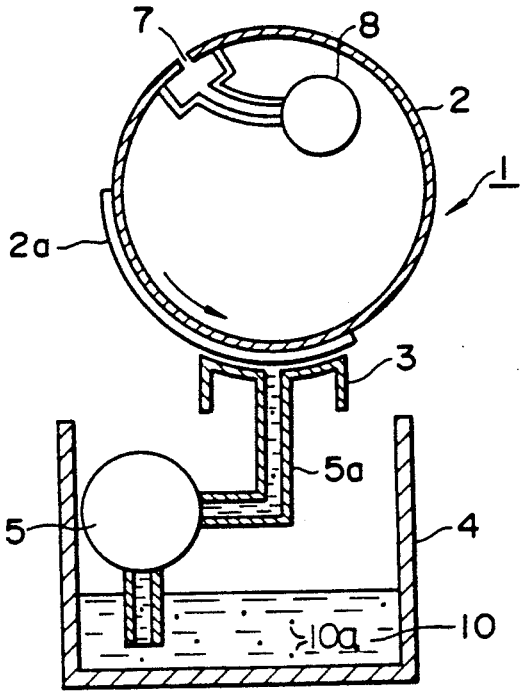
FIG. 1(A) is a front perspective view of the developing device according to the present invention in a development state.

Referring to the drawings, one embodiment of the developing device according to the present invention is described in the followings.

Figure 1B:
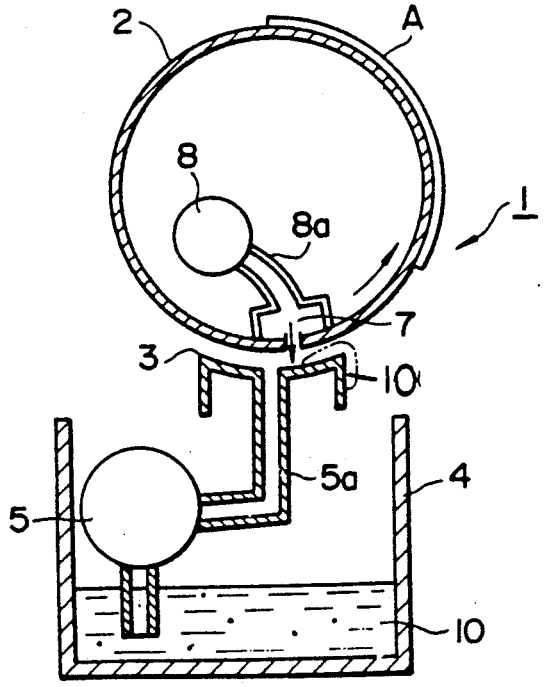
FIG. 1(B) is a front perspective view of the developing device according to the present invention in the cleaning state in which a development electrode is cleaned.

The developing device 1 is structured as shown in FIGS. 1(A) and 1(B). A development electrode 3 is disposed in a concave shape corresponding to the circumferential surface of a drum member 2 for supporting a predetermined material 2*a*, for example, a photoconductive sheet, on which a desired image is to be developed to a visible image. The development electrode 3 is disposed above a developing solution tank 4 in a manner that the development electrode 3 is always kept away from the circumferential surface of the drum member 2 by a predetermined distance. The development solution tank 4 stores a developing solution 10 in which a plurality of toner particles 10*a* are included. The developing solution 10 in the developing solution tank 4 is supplied to the development electrode 3 through a feed pipe 5*a* by a feed pump 5.

As shown in FIGS. 1(A) and (B), a slit portion 7 which is slightly longer than the width of the development electrode 3 is disposed rearward by a predetermined distance from the rear edge of the supporting position of the material 2*a* on the circumferential surface of the drum member 2, and in an axial direction of the drum member 2. An air blower member 8 is provided within the drum member 2 which blows air through an air blow pipe 8*a*, and the air is blown out to the outside of the drum member 2 through the slit portion 7. The opening for air intake, not shown, of the air blower member 8 is disposed in a predetermined position on the surface of the drum member 2.

When an image on the photoconductive material 2*a* is developed, the material 2*a* is held at a predetermined position on a circumferential surface of the drum member 2, the material being rotated along with the drum member 2. As the drum member 2 is rotated, the surface of the material 2a is evenly charged by a charge unit, not shown. After that, the surface of the material 2a is exposed by an exposure unit, not shown, in accordance with an image to be developed, thereby, a latent image corresponding to the image is formed on the surface of the material 2a. After that, the material 2a is moved in close to the development electrode 3 as the drum member rotates.

Just before the material 2a is moved close to the development electrode 3, the feed pump 5 starts a feeding operation of the developing solution 10 in the developing solution tank 4 to the development electrode 3. Thus, the material 2a on which the latent image has been formed is dipped into the developing solution 10 fed from the developing solution tank 4, on the development electrode 3, and thereby the latent image is developed into a visible image.

After the trailing end of the material 2a has passed above the development electrode 3, the feed pump 5 stops its operation, and thereby the feed operation of the developing solution 10 from the developing solution tank 4 ceases.

However, in this state, due to surface tension of the liquid and so forth, unnecessary developing solution 10 remains on the surface of the development electrode 3. After it remains for a long time, the toner particles 10a are gradually stuck to the surface of the development electrode 3, thereby dirtying the electrode surface and degrading the quality of the image to be developed.

To avoid the above problem, as shown in FIG. 1(A), a slit portion 7 is provided downstream of the material 2a along a rotating direction of the drum member 2. In this structure, after the trailing end of the material 2a has passed on the development electrode 3, the slit portion 7 approaches the development electrode 3 as the drum member 2 rotates, and the air blower member 8 starts its operation blowing out air through the slit portion 7 from the air blow pipe 8a. In this state, when the drum member 2 rotates and the slit portion 7 passes above the development electrode 3, any developing solution 10 staying on the surface of the development electrode 3 is blown off by the air from the slit portion 7, as shown in FIG. 1(B). The developing solution 10 flows down to the developing solution tank 4 from the surface of the development electrode 3 and thereby the surface of the development electrode 3 is cleaned. After the slit portion on the surface of the drum member 2 has passed above the development electrode 3 as the drum member 2 rotates, the air blower member 8 stops its operation and the cleaning operation of the development electrode 3 is completed. As described above, each time the material 2a is dipped in the developing solution 10 on the development electrode 3, the developing solution 10 remaining on the surface of the development electrode 3 is blown off thereby the surface of the development electrode 3 is always cleanly maintained.

Figure 2:
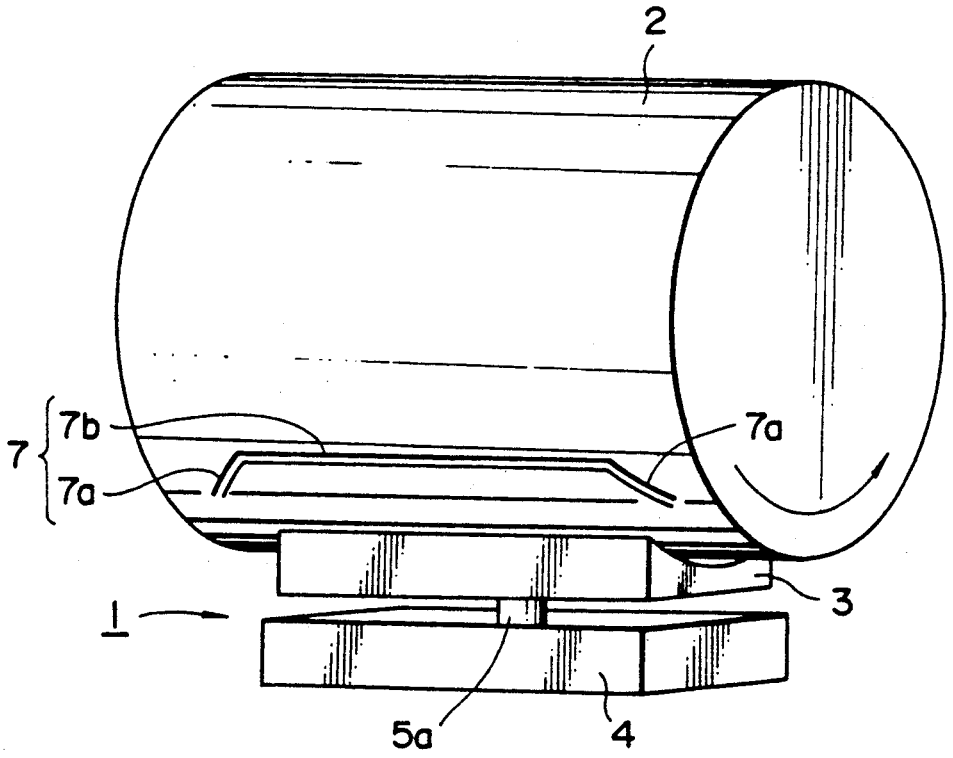
FIG. 2 is a perspective view of the developing device of FIGS. 1(A) and 1(B).

As shown in FIG. 2, the side edge parts 7a, 7a of the slit portion 7 are provided at a predetermined angle for the direction along which the drum member 2 is rotated. In this structure, the developing solution 10 on the surface of the development electrode 3 is surrounded by air from the edge parts 7a, 7a of the slit portion 7 and a central part 7b, which is slightly longer than the width of the development electrode 3, disposed perpendicular to the direction along which the drum member 2 rotates. The side edge parts 7a, 7a are bent in the rotating direction of the drum member 2, and the air blown from the edge side parts 7a, 7a form a wall of air with the air blown from the central part 7b of the slit portion 7. Therefore, the developing solution 10, splashed from the surface of the development electrode 3 by the air, is surrounded by the air and it becomes possible to prevent an any unnecessary scattering of the development solution 10 from the surface of the development electrode 3.

The developing device according to the present invention is not limited to the above embodiment. For example, in the embodiment described above, although a photoconductive sheet is used as the material on which a latent image is formed, the material may be the usual sheet and the drum member a photoconductive drum member. In addition, it may be considered that the material is integrally provided with the supporting member, i.e., the drum member in the above embodiment. Further, although the air is blown through the slit portion from the air blower member in the above embodiment, it is also possible to structure that the slit portion is connected through an open/close valve to a compressed air source instead of the air blower member and the air is blown in accordance with an open-close operation of the valve.

Furthermore, with respect to a shape of the slit portion, although the central part of the slit portion is provided perpendicular to a direction of the drum member, it is also possible to structure the slit portion in a curve shape or in a "V" shape without a portion perpendicular to a rotating direction of the drum member.

In the above embodiment, the drum member is used for supporting a material on which an image is formed. However, it is also possible to employ a plate shape member for supporting the material. In addition, instead of the rotating drum member, it is possible to employ a structure in which the development electrode is moved to the member for supporting the material on which the image is formed, or both is movable with each other.

What is claimed is:

1. A developing device utilizing a developing solution including a plurality of toner particles and comprising at least one development electrode member for generating an electric field to propel said toner particles, said developing device further comprising:

means including a drum rotating at a predetermined velocity for supporting a material on which said toner particles are to be coated on a circumferential surface thereof and feeding said material into said electric field generated by said electrode member, said drum having a predetermined positional relationship with said development electrode member; and blow means provided within said drum member and having a slit portion provided on said drum member, at a downstream side of said material in a rotating direction, through which the air from said blow member is blown out to a surface of said development electrode member after said material is coated with said toner particles having been actuated in the electric field generated by said development electrode member.

2. The developing device according to claim 1 wherein at least a part of said slit portion is provided perpendicularly to a direction along which said drum member is rotated.

3. The developing device according to claim 2 wherein a main portion of said slit portion is provided perpendicularly to said direction, while at least one edge portion integral with said main portion is provided in an inclined state with a predetermined angle against said direction.

4. The developing device according to claim 3 wherein said inclined portion of said slit portion is bent to said direction.

5. The developing device according to claim 3 wherein the other portion integral with said main portion is provided in an inclined state with said predetermined angle against said direction.

6. The developing device according to claim 2 wherein a length of said slit portion perpendicular to said direction is longer than a length of width of said development electrode member.

7. A developing process utilizing a developing solution including a plurality of toner particles and at least one development electrode member for developing an electric field to propel said toner particles, which comprises:

locating a a sheet member supported on a circumferential surface of a drum member rotating at a predetermined velocity on which said toner particles is to be coated, at a predetermined positional relationship with said development electrode member;

coating said toner particles propelled by said development electrode member on said material in accordance with a desired image; and blowing an air to a surface of said development electrode member, said air being generated by a blow member provided within said drum member and passed through a slit portion provided on the circumferential surface of said drum member.

8. The developing process according to claim 7 wherein at least a part of said slit portion is provided perpendicularly to a direction along which said drum member is rotated.

9. The developing process according to claim 8 wherein a main portion of said slit portion is provided perpendicularly to said direction, while at least one edge portion integral with said main portion is provided in an inclined state with a predetermined angle against said direction.

10. The developing process according to claim 9 wherein said inclined portion of said slit portion is bent to said direction.

11. The developing process according to claim 9 wherein the other edge portion integral with said main portion is provided in an inclined state with said predetermined angle against said direction.

12. The developing process according to claim 8 wherein a length of said slit portion perpendicular to said direction is longer than a length of width of said development electrode member.

13. A development electrode cleaning unit, adapted to be positioned in a developing device having a support member movable in a predetermined direction for supporting a material on which a developing operation is executed and utilizing a liquid development solution including toner particles and at least one development electrode member for generating an electric field in which said toner particles are propelled said unit comprising a blow member for blowing air to a surface of said development electrode member after the developing operation through a slit portion provided on said support member, said slit portion being provided in such a manner that a main portion of said slit portion on said surface of said supporting member is perpendicular to said predetermined direction, while at least one edge portion of said slit portion is inclined at a predetermined angle against said predetermined direction.

14. The development electrode cleaning unit according to claim 13 wherein said inclined portion of said slit portion is bent to said predetermined direction.

15. The development electrode cleaning unit according to claim 13 wherein the other edge portion integral with said main portion is provided in an inclined state with said predetermined angle against said predetermined direction.

16. The development electrode cleaning unit according to claim 13 wherein a length of said slit portion perpendicular to said direction is longer than a length of width of said development electrode member.

* * * * *